United States Patent [19]

Ameling

[11] 3,983,723

[45] Oct. 5, 1976

[54] APPARATUS FOR WET-TREATING MATERIALS

[75] Inventor: Bernhard Ameling, Coesfeld, Westphalia, Germany

[73] Assignee: Thies KG, Coesfeld, Westphalia, Germany

[22] Filed: Nov. 11, 1974

[21] Appl. No.: 522,930

Related U.S. Application Data

[62] Division of Ser. No. 425,662, Dec. 17, 1973, abandoned.

[30] Foreign Application Priority Data

Dec. 20, 1972 Germany ..... 2262309

[52] U.S. Cl. ..... 68/5 E; 68/5 C; 68/18 R

[51] Int. Cl.[2] ..... D06B 1/02; D06B 3/02

[58] Field of Search ..... 68/5 C, 5 D, 5 E, 6, 68/7, 18 R, 18 C, 183, 189, 9, 62; 8/149.1, 149.2, 149.3

[56] References Cited

UNITED STATES PATENTS

| | | | |
|---|---|---|---|
| 1,948,568 | 2/1934 | Faber et al. | 68/5 C X |
| 3,426,554 | 2/1969 | Simons | 8/149.1 X |
| 3,521,998 | 7/1970 | Gruner et al. | 68/51 D X |
| 3,600,731 | 8/1971 | Bergholtz | 68/183 X |
| 3,730,678 | 5/1973 | Wedler et al. | 8/149.1 |
| 3,762,866 | 10/1973 | Rayment et al. | 68/5 C X |
| 3,783,650 | 1/1974 | Weber et al. | 68/18 C |

*Primary Examiner*—Philip R. Coe
*Attorney, Agent, or Firm*—Michael J. Striker

[57] ABSTRACT

A treating liquid in form of a preferably highly concentrated solution or dispersion is entrained in a stream of gas, and the thus-entrained finely divided particles of liquid are sprayed against a material to be treated.

7 Claims, 5 Drawing Figures

APPARATUS FOR WET-TREATING MATERIALS

This is a division of application Ser. No. 425,662, filed Dec. 17, 1973, and now abandoned.

BACKGROUND OF THE INVENTION

The present invention relates to the wet-treating of materials, and more particularly to a novel apparatus for carrying out the wet-treating of materials. There are many instances in which a material must be wet-treated, that is contacted with a treating liquid. For instance, there are materials that must be contacted with a bleaching liquid, there are materials which must be subjected to contact with a liquid for pre-treatment or post-treatment purposes, or materials —such as textile materials —which must be contacted with liquid dyestuff or the like. The present invention is particularly advantageous in the context of the dyeing of textile materials, and will be described with reference thereto, but should be understood to be suitable for all other liquid-treatment applications also.

It is the conventional practice in wet-treating of materials to use liquid media, usually aqueous solutions or dispersions, but sometimes other liquids such as alcohol or halogenated hydrocarbons. In any event, the liquid required, be it water, alcohol, halogenated hydrocarbons or the like, is needed in prodigious quantities and this results both in a wase of resources and —since the spent liquid will eventually be discharged to the environs— in ecological contamination.

SUMMARY OF THE INVENTION

It is a general object of the present invention to overcome the disadvantages of the prior art.

More particularly, it is an object of the present invention to provide a novel wet-treating apparatus for materials wherein the amount of liquid required for the treating purposes is substantially reduced, thus conserving the particular liquid.

An additional object of the invention is to provide such a novel apparatus wherein, as a result of the reduction in the amount of liquid being used, the amount of liquid discharged to the environs is similarly reduced and ecological contamination is significantly decreased.

Still a further object of the invention is to provide an efficient apparatus for carrying out the operation.

In keeping with the above objects, and with others which will become apparent hereafter, one feature of the invention resides in an apparatus for wet-treating materials, particularly the dyeing of textile materials, which comprises entraining a treating liquid in a stream of gas, and spraying the finely divided treating liquid particles on a material to be treated.

Advantageously, the treating liquid will be as highly concentrated as practicable, being provided in form of a solution or a dispersion. The treating liquid may be a liquid medium based on water or on organic solvents, such as for instance halogenated hydrocarbons.

The stream of gas may be a stream of air, particularly a stream of air which is saturated with water vapor at the operating temperature, or it may be a stream of an inert gas. It is currently preferred that the operation take place at elevated temperature, and that it take place at a static pressure which is higher than the vapor pressure of the liquid medium at the operating temperature.

The operation can be carried out continuously or discontinuously, in the latter case particularly in nozzle-type dyeing machines which are conventionally used for dyeing of textile piece goods.

The most commonly used liquid medium in the prior art, and also according to the present invention, involves a water-based treating liquid, and for this reason the present invention will hereafter be described with reference to a water-based treating liquid and with reference to an operation for dyeing of textiles, as pointed out earlier.

According to the prior art the dyestuffs and any additives that are required —which may be present in form of liquids, pastes or powders— are dissolved in a liquid or dispersed therein. The various dyestuffs and additives have greatly differing dissolution or dispersion capabilities.

The amount of dyestuff required is determined by the color density that is desired and the weight of the textile material that is to be dyed. As an example, 5% of dyestuff (with reference to the weight of the textile material to be dyed) are needed if the dissolution capability of the dyestuff is for instance 100 g/l of liquid and the textile material weighs 100 kg. This means, in other words, that 5 kg of dyestuff must be dissolved in 50 liters of water, the latter being the minimum amount of water that can be used. This is a ratio of textile weight to water weight of 1 : 0.5.

However, in the apparatus used in the prior art the thus-obtained solution must be further thinned with water in order to obtain a uniform distribution of the dissolved dyestuff over the textile material being treated. In actual fact, a final ratio of textile weight to water weight of 1 : 7 up to 1 : 10 is required in the prior art. The solution having this ratio is pressed through the textile material by means of a circulating pump, and during each pass of the solution through the textile material dyestuff from the solution is yielded up to the textile material, until a condition of equilibrium between dyestuff solution and textile has been reached, or until the dyestuff has been completely withdrawn from the solution and has entered the textile material. In the case of some of the dyestuffs the dyeing operation is carried out at a temperature higher than the boiler temperature of the water, which means that the operation must be undertaken in a closed-circulation apparatus in which the pressure can be so adjusted that an evaporation of the water or whatever other liquid medium is used, is reliably avoided.

Of course, it is well known that with the type of dyestuffs used for textile dyeing, an affinity of dyestuff to textile fiber exists only if the dyestuff is dissolved in a liquid medium. For this reason, the invention also operates with a liquid phase in which the dyestuff is dissolved or dispersed. The invention, however, proposes to use a saturated solution or dispersion which contains only the absolutely necessary minimum amount of liquid. In order to obtain under these circumstances a uniform distribution over and throughout the textile material to be treated, an additional vehicle is required which, according to the present invention, is a stream of gas, usually a stream of air, in which the liquid is entrained. Any suitable means can be provided for spraying the liquid into the airstream and for spraying the entrained liquid via the airstream on and through the textile material.

Since the dyestuffs do not become dissolved in gas, and since therefore the stream of gas can be readily freed of dyestuff residue, and since particularly air is available readily in large quantities, air is usually preferred to produce the stream of gas, but it should be understood that various inert gases can similarly be utilized.

The present invention is advantageously also carried out at temperatures above the boiling point of the liquid medium, as in the prior art. For this reason the pressure existing in the novel apparatus must be high enough so that an evaporation of the liquid medium constituting a part of the dyestuff solution or dispersion, is reliably avoided. Liquid medium is so admitted into the stream of gas that a fine liquid-particle distribution is obtained and that the exceeding of a certain droplet size is avoided. After the gas stream containing the entrained particles has passed through the textile material the residual dyestuff still entrained in it is again removed from it, by means of already known separators.

The novel features which are considered as characteristics for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
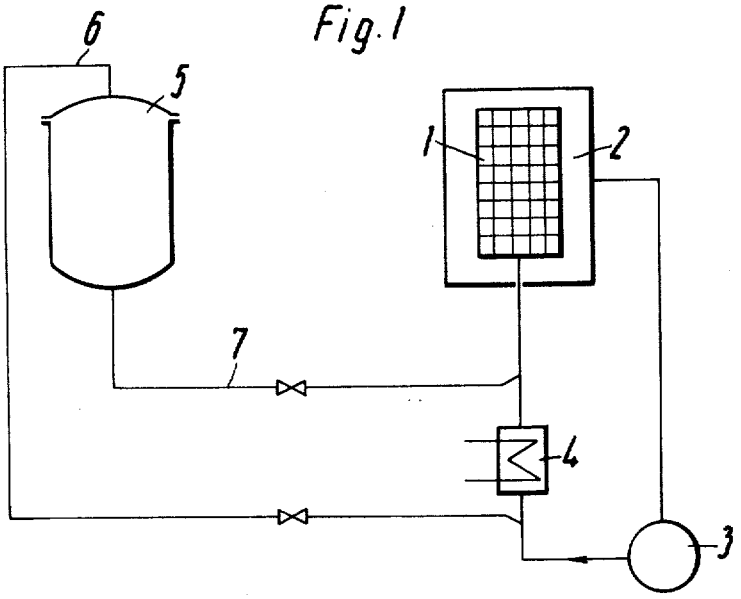
FIG. 1 is a diagrammatic illustration showing an apparatus according to the present invention for the discontinuous dyeing of textile material.

Before referring in detail to the drawing it should be understood that all Figures show the novel apparatus only in a diagrammatic manner, and that all components which are not essential for an understanding of the invention have been omitted. Thus, valves, devices for producing pressure and the like which are all clearly within the level of skill of those conversant with this art, have not been illustrated.

Referring now to FIG. 1, it will be seen that reference numeral 1 identifies the material to be treated, i.e. in this case textile material. Reference numeral 2 identifies a container into which the textile material 1 is introduced for treating purposes. Reference numeral 3 identifies a blower, reference numeral 4 a heater for heating a stream of gas and entrained liquid particles, reference numeral 5 a vessel which contains a body of dyestuff solution or dispersion, and reference numerals 6 and 7 identify conduits which establish connections between the container 2 and the vessel 5.

Figure 2:
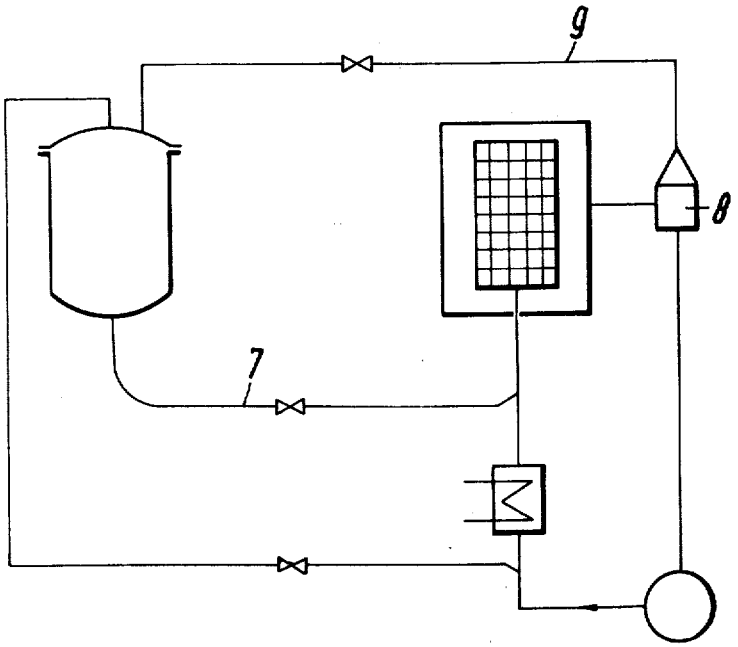
FIG. 2 is a digrammatic illustration similar to FIG. 1, but showing an apparatus which is additionally provided with an arrangement for separating residual dyestuff from the entraining airstream.

The same reference numerals are used in FIG. 2 to identify the same components. In addition, however, reference numeral 8 in FIG. 2 identifies a known separating device 8 wherein liquid is separated from the entraining gas stream, and reference numeral 9 identifies a conduit via which the separated liquid is returned to the vessel 5.

FIG. 3 again shows a container 2 through which, however, the textile material 1 is continuously advanced. Reference numeral 3*a* identifies seals at the inlet and outlet openings of the container 2. The vessel for the treating liquid is identified with reference numeral 5 and the conduits with reference numerals 6 and 7, respectively. Reference numeral 3 again identifies the blower for circulating the gas stream, and reference numeral 4 the heater.

Figure 3:
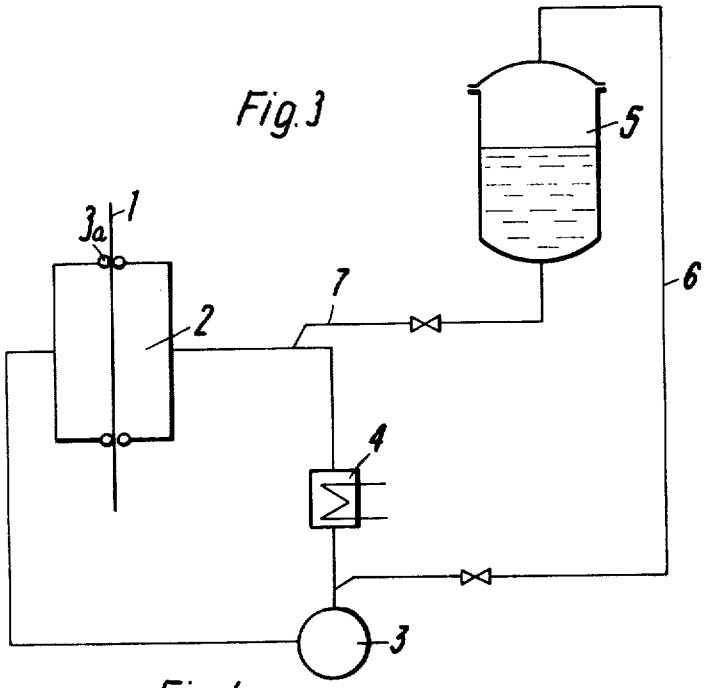
FIG. 3 is a further diagrammatic view, illustrating an apparatus for the continuous dyeing of textile materials.
Figure 4:
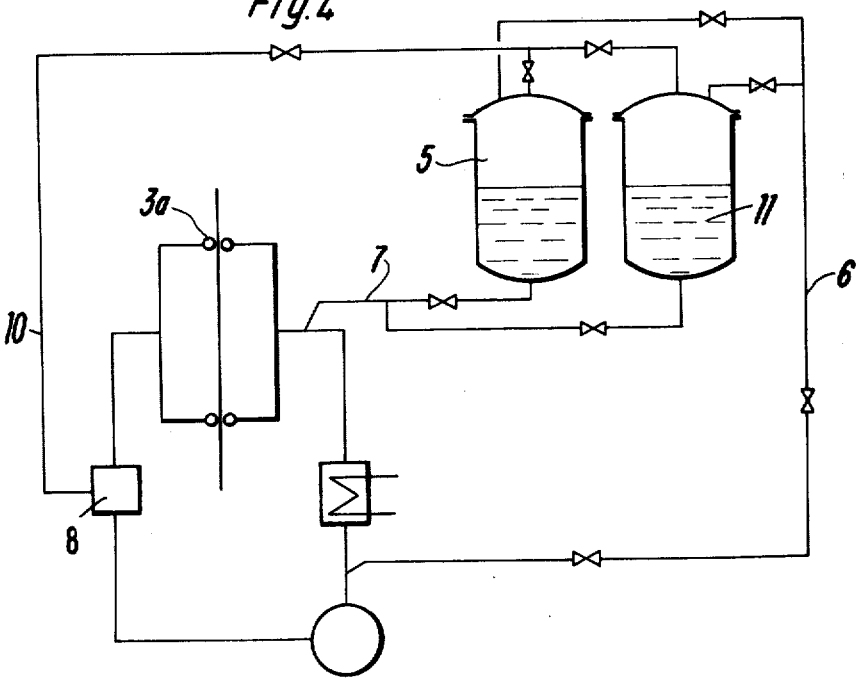
FIG. 4 is a view similar to FIG. 3, but illustrating an apparatus which is further provided with an arrangement for separating residual dyestuff from an entraining airstream.

FIG. 4 is like FIG. 3; identical reference numerals identify identical components. FIG. 4, however, shows additionally the separating device 8 wherein liquid particles are separated from the entraining gas stream, and a conduit 10 via which the separated liquid is returned into a further vessel 11.

Figure 5:
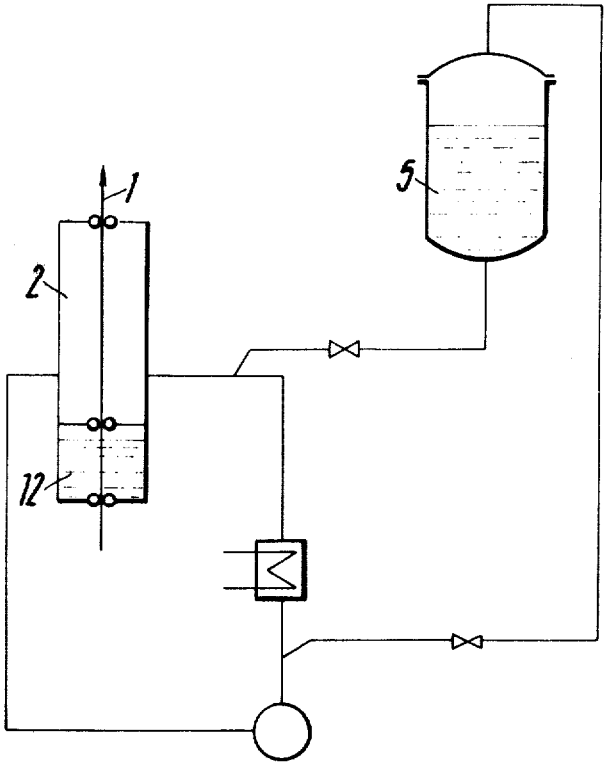
FIG. 5 illustrates diagrammatically a further apparatus for the continuous dyeing of textile materials.

FIG. 5, finally, is analogous to FIG. 4, again using identical reference numerals to identify like components. In FIG. 5, however, the vessel 12 which corresponds to the vessel 11 of FIG. 4, is arranged below the container 2.

If the apparatus according to the present invention is to be used for dyeing textile material, the textile material 1 which may be in form of wound bodies, strands, flock, nonwoven material or fleece, is accommodated on appropriate carriers which are known from the art and is introduced into the container 2. The latter and the carrier or carriers for the textile material are provided with arrangements known per se from the art which engage one another so that the carrier can be placed sealingly onto the inlet conduit which enters the container 2. After the textile material 1 is in place, the container 2 is tightly closed.

The requisite quantity of treating liquid is introduced into the vessel 5 and by means of a pressure source which is known from the art the vessel 5, the container 2 and all associated conduits are now subjected to a static pressure whose level is so selected that an evaporation of the liquid treating medium at the operating temperature is avoided. The blower 3 is now energized and the gas under pressure in the interior of the apparatus is circulated, entraining particles of the treating liquid and passing them through the textile material. The heating unit 4 maintains the gas stream at the requisite temperature.

Valves which are diagrammatically shown in the various Figures and are interposed in the conduits 6 and 7 serve to admit controlled quantities of the treating liquid into the gas stream. The conduit 7 is so connected with the gas stream circulating conduit that the gas stream produces an injector effect, i.e. it will cause a suction in the conduit 7 and thus draw treating liquid into the gas stream. The conduit 6 is so arranged that the flow pressure of the gas stream facilitates the outflow of liquid from the container 5. Of course, appropriate pumps or similar devices may be used for admitting dosed quantities of liquid into the gas stream. The circulation of the gas stream with the entrained liquid particles therein can be switched by the use of appropriate control valves or the like, so that the mixture can selectively be passed from outside inwardly through the textile material, or else from inside in direction outwardly through the textile material. The circulation continues until the dyestuff has been yielded up from the liquid to the extent necessary to cause the desired degree of dyeing of the textile material 1.

In addition to this basic operation of the apparatus as described with reference to FIG. 1, the embodiment of FIG. 2 makes it possible —after the stream of gas with its still entrained liquid has passed through the textile material 1— to separate the entrained liquid from the gas stream by means of the device 8, either wholly or partially, and to return the separated liquid into the vessel 5, either via gravity flow or by the aid of an additional pump which is not shown. The valve in the conduit 7 is used in all embodiments to so arrange the dosing effect that the desired droplet size of liquid in the entraining gas stream is obtained.

The apparatus shown in FIGS. 3 and 4 differ from those in FIGS. 1 and 2 in that here the container 2 is intended for continuous passage of the textile material, rather than for batchwise operation. The textile material here is in form of sheet material, fleece, flock or nonwoven material which can travel continuously through the container 2 from an inlet to an outlet thereof, and for this purpose the container 2 is provided at the inlet and outlet with roller-type or other seals 3*a* which maintain a sufficient seal so that the selected pressure in the interior of the container 2 will not be lost.

In FIG. 4 there is provided a further vessel 11 into which the separated liquid is admitted. This is desirable to obtain a uniformity in coloring or dyeing depth of the textile material 1. The separated liquid is brought up to the necessary dye concentration in the vessel 11, to assure that there are no fluctuations in the concentration of liquid that is being admitted into the gas stream.

In the embodiment of FIG. 5, finally, the textile material 1 again passes continuously through the container 2. Here, however, the collecting vessel 11 of FIG. 4 is replaced by a similar vessel 12 which is located immediately below and upstream of the container 2, so that the textile material 1 first passes through the vessel 12 in which it becomes uniformly saturated with the treating liquid, to thereupon enter into the container 2 wherein the treating liquid is fixed by means of a hot moist stream of gas, for instance air. In this case, the vessel 5 contains a treating liquid such as water or another suitable liquid which serves to fix the dyestuff, rather than to apply it to the textile material 1 in the first place, since such application takes place as the material passes through the vessel 12.

It will be understood that each of the elements described above, or two or more together, may also find a useful application in other types of applications differing from the types described above.

While the invention has been illustrated and described as embodied in the wet-treating of textile materials, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptions should and are intended to be comprehended within the meaning and range of equivalence of the following claims.

What is claimed as new and desired to be protected by Letters Patent is set forth in the appended claims.

1. In an apparatus for wet-treating materials, particularly for dyeing textile materials, a combination comprising a container for containing material to be treated; a vessel for containing a treating liquid intermediate an upper inlet and a lower outlet; means for conducting a stream of carrier gas in a flow path towards said container; means for drawing the treating liquid from said vessel and into the presence of said carrier gas, comprising a first conduit in communication with a first portion of said flow path and also communicating with said inlet above the level of liquid in said vessel, and a second conduit intermediate said outlet and a second portion of said flow path which is downstream of said first portion so as to draw the liquid into the stream of carrier gas and obtain a finely dispersed mixture; means for circulating the mixture into said container under pressure so as to spray the mixture onto the material to be treated; and means for returning the spent mixture to said conducting means.

2. A combination as defined in claim 1; and further comprising means for at least intermittently transporting the material to be treated through said container.

3. A combination as defined in claim 1; and further comprising means for continuously transporting the material to be treated through said container.

4. A combination as defined in claim 3, said transporting means comprising sealing means at the inlet and outlet of said vessel for sealingly engaging the material to be treated without loss of pressure.

5. A combination as defined in claim 1, and further comprising means for heating the stream of carrier gas in said flow path intermediate said first and second portions thereof.

6. A combination as defined in claim 1; and means for separating the liquid component of the mixture from the carrier gas component, comprising a separator unit having inlet means for receiving the spent mixture from said container and outlet means having an outlet conduit in communication with the conducting means for returning the separated gas component thereto, and another outlet conduit in communication with said vessel for returning the separated liquid component thereto.

7. A combination as defined in claim 6; and further comprising another vessel into which the separated liquid component is conducted, said vessels having commonly connected inlet pipes in communication with said other outlet conduit, and commonly connected outlet pipes in communication with said conducting means; and further comprising a plurality of valves each located in respective ones of said inlet and outlet pipes for regulating the flow of the liquid from said vessels.

* * * * *